US012507762B2

(12) United States Patent
Liu et al.

(10) Patent No.: US 12,507,762 B2
(45) Date of Patent: Dec. 30, 2025

(54) MIDSOLE AND SHOE INCLUDING THE SAME

(71) Applicant: POU CHEN CORPORATION, Chang Hwa Hsien (TW)

(72) Inventors: Chia-Hua Liu, Chang Hwa Hsien (TW); Jou-Chun Liao, Chang Hwa Hsien (TW); Kai-Han Liang, Chang Hwa Hsien (TW)

(73) Assignee: POU CHEN CORPORATION, Chang Hwa Hsien (TW)

( * ) Notice: Subject to any disclaimer, the term of this patent is extended or adjusted under 35 U.S.C. 154(b) by 0 days.

(21) Appl. No.: 18/768,277

(22) Filed: Jul. 10, 2024

(65) Prior Publication Data

US 2025/0017316 A1 Jan. 16, 2025

(30) Foreign Application Priority Data

Jul. 11, 2023 (TW) ..... 112125908

(51) Int. Cl.
*A43B 13/18* (2006.01)

(52) U.S. Cl.
CPC ..... *A43B 13/181* (2013.01)

(58) Field of Classification Search
CPC ..... A43B 13/181; A43B 13/20; A43B 13/203; A43B 13/206
See application file for complete search history.

(56) References Cited

U.S. PATENT DOCUMENTS 2,100,492 A * 11/1937 Sindler ..... A43B 13/206 525/349
4,523,393 A * 6/1985 Inohara ..... A43B 13/206 36/35 B
12,302,982 B2 * 5/2025 Dong ..... A43B 13/186
2004/0154189 A1 * 8/2004 Wang ..... A43B 13/12 36/28

* cited by examiner

*Primary Examiner* — Ted Kavanaugh
(74) *Attorney, Agent, or Firm* — Burris Law, PLLC

(57) ABSTRACT

A midsole includes a midsole body and a resilient plate disposed in the midsole body in a manner that the resilient plate extends along a longitudinal direction. The resilient plate includes a plurality of resilient tubular elements that are integrally connected to each other along the longitudinal direction. Each of the resilient tubular elements extends along a width direction perpendicular to the longitudinal direction. A shoe includes an upper, an outsole, and the aforementioned midsole which is connected between the upper and the outsole.

5 Claims, 11 Drawing Sheets

MIDSOLE AND SHOE INCLUDING THE SAME

CROSS-REFERENCE TO RELATED APPLICATION

This application claims priority to Taiwanese Invention Patent Application No. 112125908, filed on Jul. 11, 2023, the entire disclosure of which is incorporated by reference herein.

FIELD

The disclosure relates to a part of a shoe, and more particularly to a midsole, and a shoe including the same.

BACKGROUND

A midsole of a shoe conventionally employs ethylene-vinyl acetate (EVA) material, a foaming material, or is made by 3D printing technique. Although these materials or technique are capable of achieving variation in hardness, it is difficult for these materials or technique to provide comfort, buffering and resilient properties at the same time in terms of sports performance. In addition, the effect of enhancement in smoothness is difficult to achieve if only a single material or structure is applied.

EVA material and foaming material usually provide superior buffering effect, and are capable of reducing impacts during stepping; however, these materials have poor resiliency, and cannot effectively rebound or provide efficient energy transmission. As such, sports performance might be reduced, especially in sports that demand efficient rebounding and moving forward, such as running or jumping.

3D printing technique is capable of producing complicated structures and shapes, but still encounters limitation of single material or structure. Although one can adjust the hardness of a structure according to requirements, it is still difficult to achieve a combination of comfort, shock absorption, and resiliency.

SUMMARY

Therefore, an object of the disclosure is to provide a midsole and a shoe including the same that can alleviate at least one of the drawbacks of the prior art.

According to a first aspect of the disclosure, a midsole includes a midsole body and a resilient plate disposed in the midsole body in a manner that the resilient plate extends along a longitudinal direction. The resilient plate includes a plurality of resilient tubular elements that are integrally connected to each other along the longitudinal direction. Each of the resilient tubular elements extends along a width direction perpendicular to the longitudinal direction.

According to a second aspect of the disclosure, a shoe includes an upper, an outsole, and a midsole of the present disclosure. The midsole is connected between the upper and the outsole.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
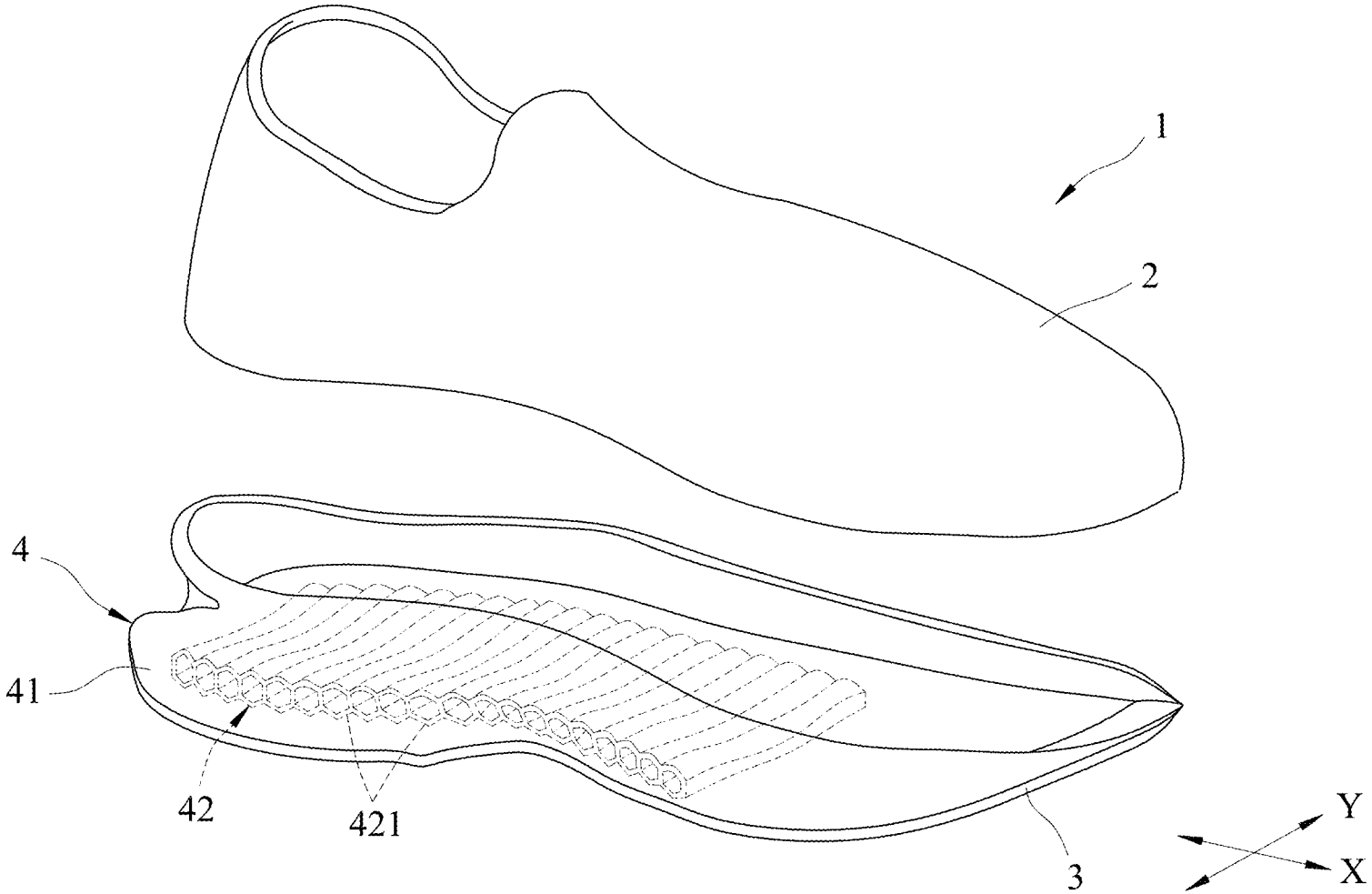
FIG. 1 is an exploded perspective view of a shoe including a midsole according to a first embodiment of the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
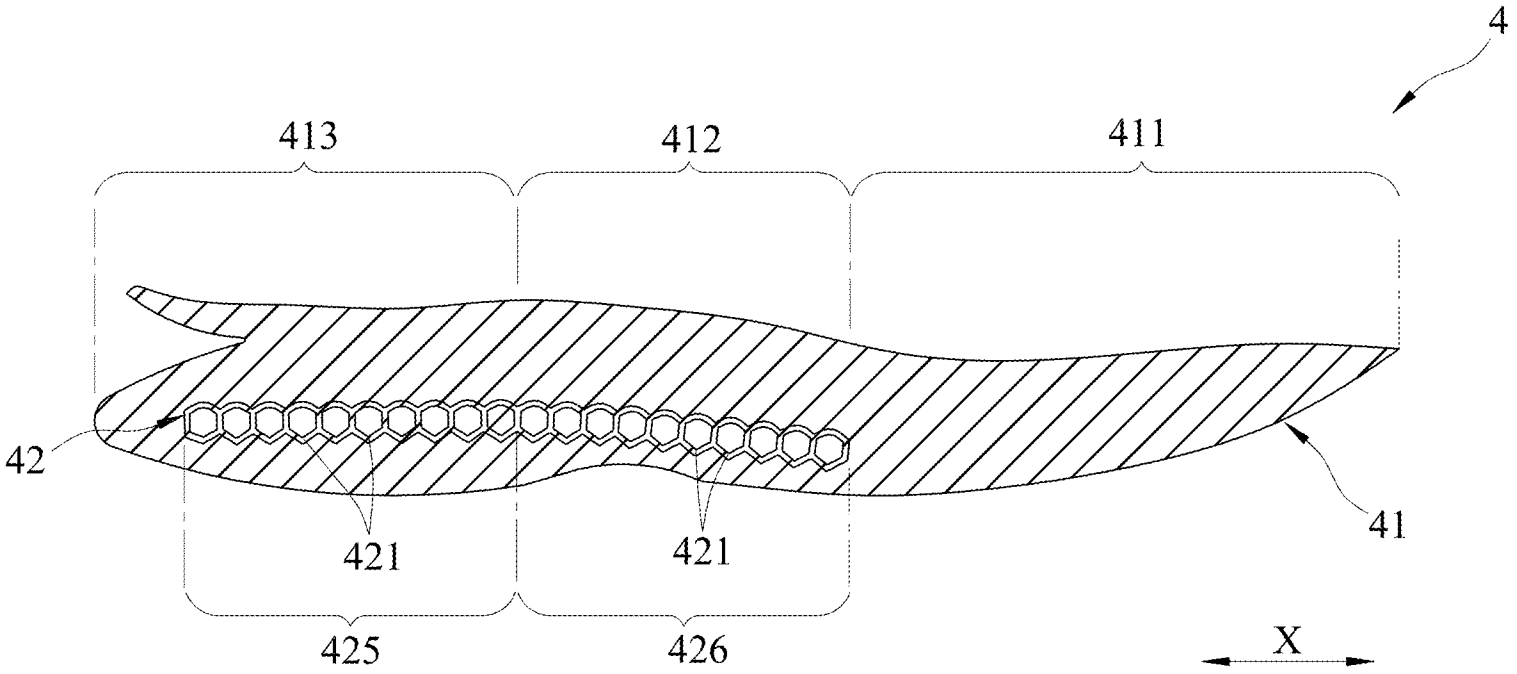
FIG. 2 is a schematic cross-sectional side view of the midsole according to the first embodiment of the disclosure.
Figure 3:
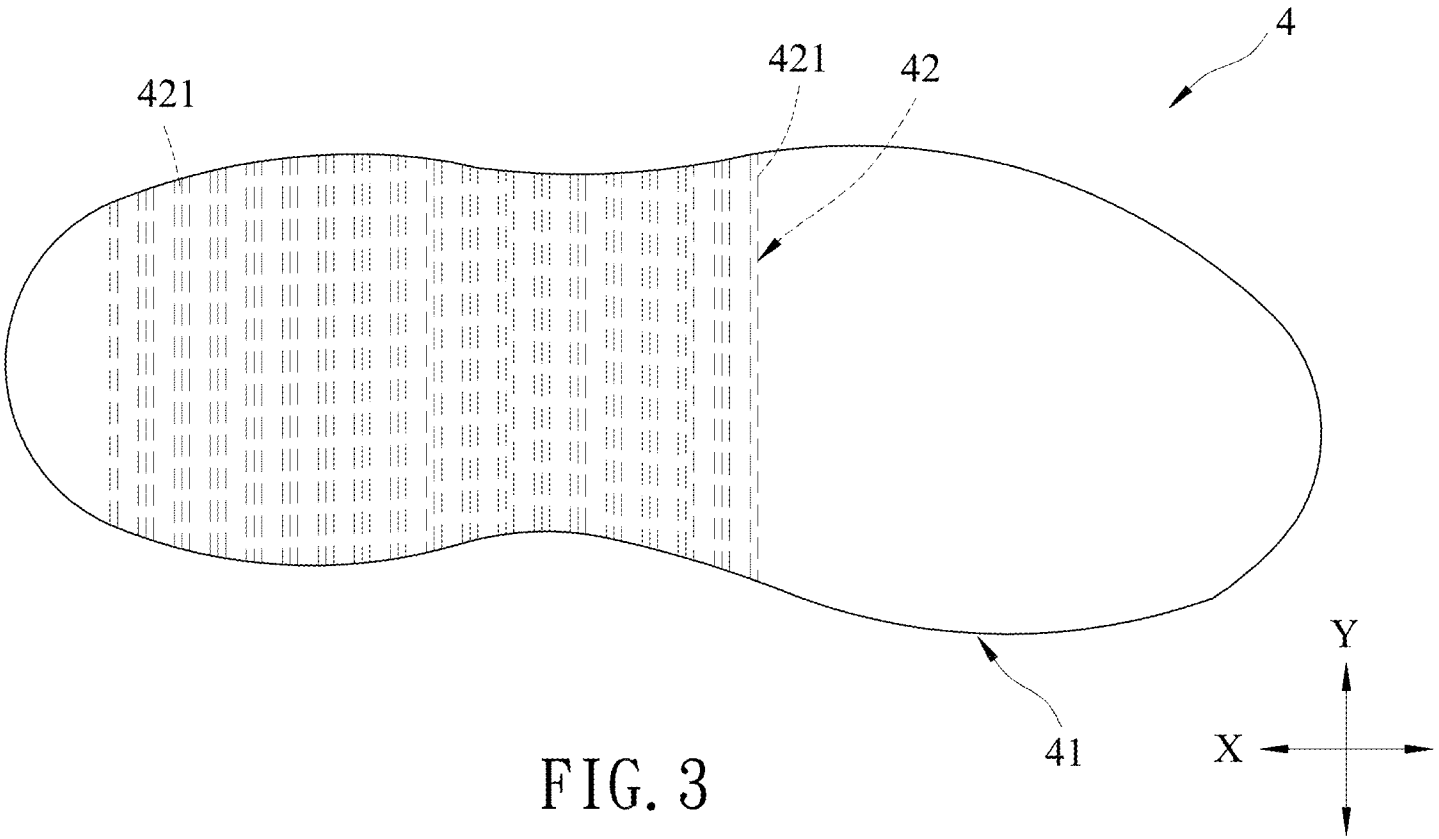
FIG. 3 is a schematic top view of the midsole according to the first embodiment of the disclosure.

Referring to FIGS. 1 to 3, according to a first embodiment of the present disclosure, a shoe 1 includes an upper 2, an outsole 3, and a midsole 4 connected between the upper 2 and the outsole 3.

The midsole 4 includes a midsole body 41, and a resilient plate 42.

The midsole body 41 includes a forefoot region 411, a midfoot region 412 integrally connected to the forefoot region 411, and a heel region 413 integrally connected to the midfoot region 412. The forefoot region 411 corresponds to a forefoot of a runner, the midfoot region 412 corresponds to an arch of a foot of the runner, and the heel region 413 corresponds to a heel of the runner.

The midsole body 41 is an integral component made of at least one of the material selected from ethylene-vinyl acetate (EVA) copolymer and polyurethane (PU) by a foaming process such as supercritical fluid foaming, but is not limited thereto. The midsole body 41 may also be made of a thermoplastic polyurethane (TPU) material by an additive manufacturing process.

The resilient plate 42 is disposed in the heel region 413 and the midfoot region 412 of the midsole body 41 in a manner that the resilient plate 42 extends along a longitudinal direction (X). The resilient plate 42 includes a plurality of resilient tubular elements 421 that are integrally connected to each other along the longitudinal direction (X). Each of the resilient tubular elements 421 is elongated and extends along a width direction (Y) perpendicular to the longitudinal direction (X). Each of the resilient tubular elements 421 is a tube with a cross section in a hexagonal shape, or a substantially hexagonal shape. It should be noted that, in other embodiments, each of the resilient tubular elements 421 may also be a tube with a cross section in a quadrilateral shape, a pentagonal shape, a rhombus shape, or a circular shape, but is not limited thereto.

The resilient plate 42 is made of at least one of the material selected from thermoplastic polyester elastomer (TPEE), polyester-based thermoplastic polyurethane (TPU), polyether-based thermoplastic polyurethane (TPU), an elastic nylon (such as a polyether block amide under the trade name of PEBAX®), a polypropylene (PP) elastomer (such as ethylene-propylene copolymer), and rubber. The resilient plate 42 cooperates with the midsole 41 to form a composite structure.

Figure 4:
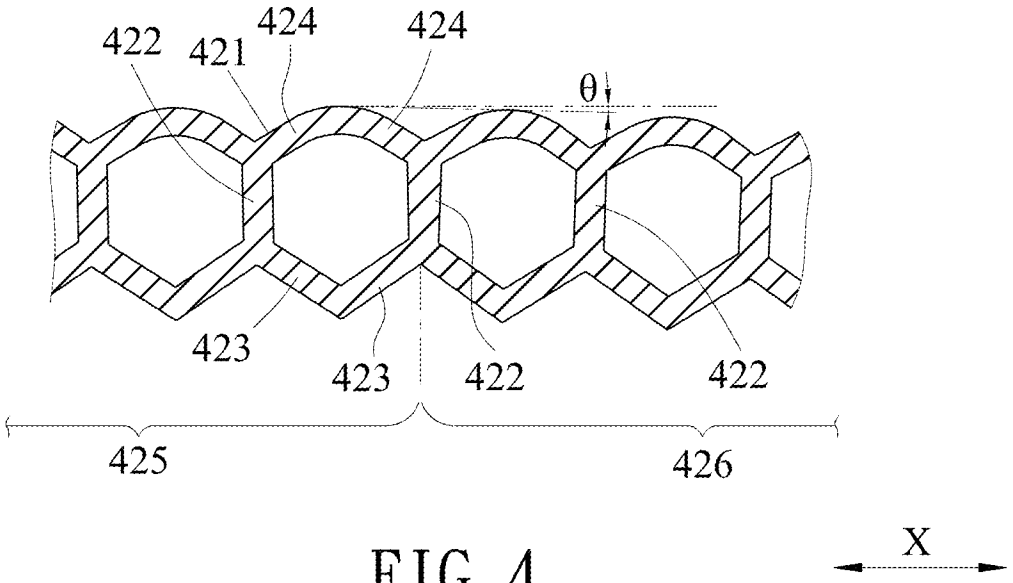
FIG. 4 is a schematic fragmentary cross-sectional side view of a resilient plate of the midsole according to the first embodiment of the disclosure.

Referring to FIGS. 2 and 4, each of the resilient tubular elements 421 includes: two connection walls 422 that are spaced apart from each other along the longitudinal direction (X); two lower end walls 423 that respectively extend from bottoms of the two connection walls 422 and that are connected to each other; and two upper end walls 424 that respectively extend from tops of the two connection walls 422 and that are connected to each other. A connection of the two upper end walls 424 of each of the resilient tubular elements 421 is a chamfer having a curved surface.

A first portion of the resilient tubular elements 421 that is located at the heel region 413 serves as a first plate portion 425 (or known as a rear plate portion). A second portion of the resilient tubular elements 421 that is located at the midfoot region 412 serves as a second plate portion 426 (or known as a middle plate portion). The second plate portion 426 has a connected end that is connected to the first plate portion 425, and a distal end that is distal from the first plate portion 425 and opposite to the connected end. The second plate portion 426 gradually deflects downwardly along a direction from the connected end toward the distal end.

Referring to FIGS. 2 and 4, the first plate portion 425 is disposed within the heel region 413 in a manner that the first plate portion 425 is substantially parallel to an upper surface of the heel region 413. The upper surface of the heel region 413, along the longitudinal direction (X), has a structure that a rear part thereof is located at a position higher than a front part thereof. As such, when the shoe 1 (see FIG. 1) having the midsole 4 is laid flat on the ground (not shown), the first plate portion 425 forms an angle with the ground of substantially 10°. In addition, the second plate portion 426, having the distal end pointing toward the ground, forms a deflection angle (θ) with respect to the first plate portion 425. Referring to FIG. 4, the deflection angle (θ) ranges from greater than 0° and up to 25°, such as from 5° to 10°.

A time period for a foot of a runner to be in contact with the ground is divided into three phases, namely a loading phase, a midstance phase, and a terminal stance phase. The loading phase refers to a time period from the runner having his heel being in initial contact with the ground to having his forefoot being in contact with the ground. The midstance phase refers to a time period from the runner having his foot laid flat (the state that both the heel and the forefoot of the runner are laid flat on the ground) to having his heel left the ground. The terminal stance phase refers to a time period from the runner having his heel left the ground to having his toes left the ground.

As the runner puts on the shoe 1 of the present disclosure, at the moment that the runner has his heel hitting the ground, the shoe 1 is in contact with the ground, and the midsole 4 forms an angle with the ground substantially ranging from 15° to 20°. At such circumstance, the first plate portion 425 forms an angle with the ground substantially ranging from about 5° to 10°. Therefore, the first plate portion 425 can effectively absorb impact due to the shoe 1 hitting on the ground and provide buffering to the foot.

During the loading phase to the midstance phase, in a process that a center of gravity of the runner shifts from his heels to his forefoot, as soon as the center of gravity shifts to the arch of the foot, by virtue of the second plate portion 426 gradually deflecting downwardly from the connected end toward the distal end, the second plate portion 426 experiences a downward pushing force and thus generates an upward resilience to drive the runner to move forward. As such, the process of shifting the center of gravity from his heel to his forefoot is even faster, thereby saving efforts and enhancing smoothness of running.

During the terminal stance phase, the absence of the resilient plate 42 permits the forefoot 411 to be soft and easier to be bent, so as to provide the runner with improved flexibility for better push-off.

Figure 5:
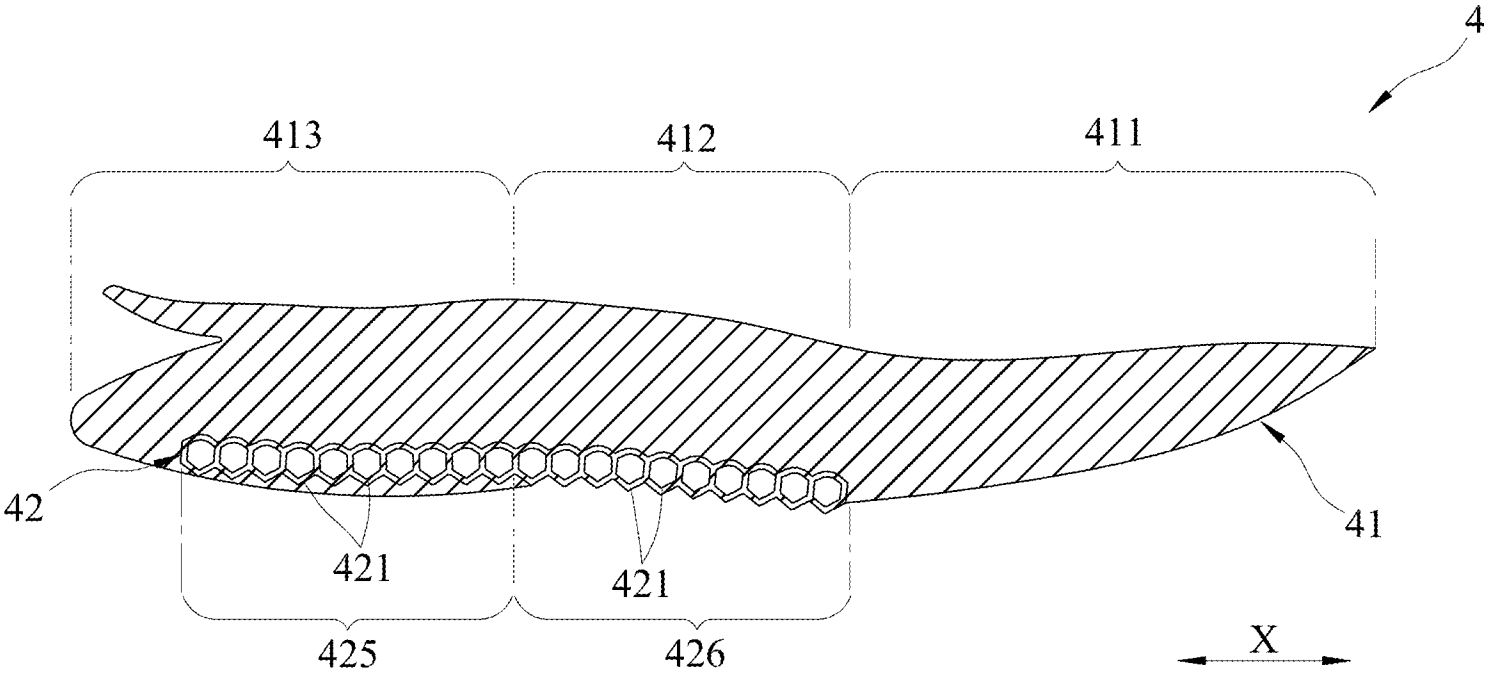
FIG. 5 is a schematic cross-sectional side view of a midsole according to a second embodiment of the disclosure.

Referring to FIG. 5, the shoe 1 of a second embodiment of the present disclosure (the upper 2 and the outsole 3 are omitted in FIG. 5) is similar to that of the first embodiment, except that in the second embodiment, the second plate portion 426 is exposed outwardly from a bottom of the midfoot region 412. With such configuration, as soon as the center of gravity of the runner shifts to the arch of his foot, the second plate portion 426 experiences a downward pushing force to abut the outsole 3 (see FIG. 1) and to deform, resulting in generation of a relatively larger upward resilience. As such, the effect of driving the runner to move forward is more significant, and thus the process of shifting the center of gravity from the runner's heel to his forefoot is even faster.

Figure 6:
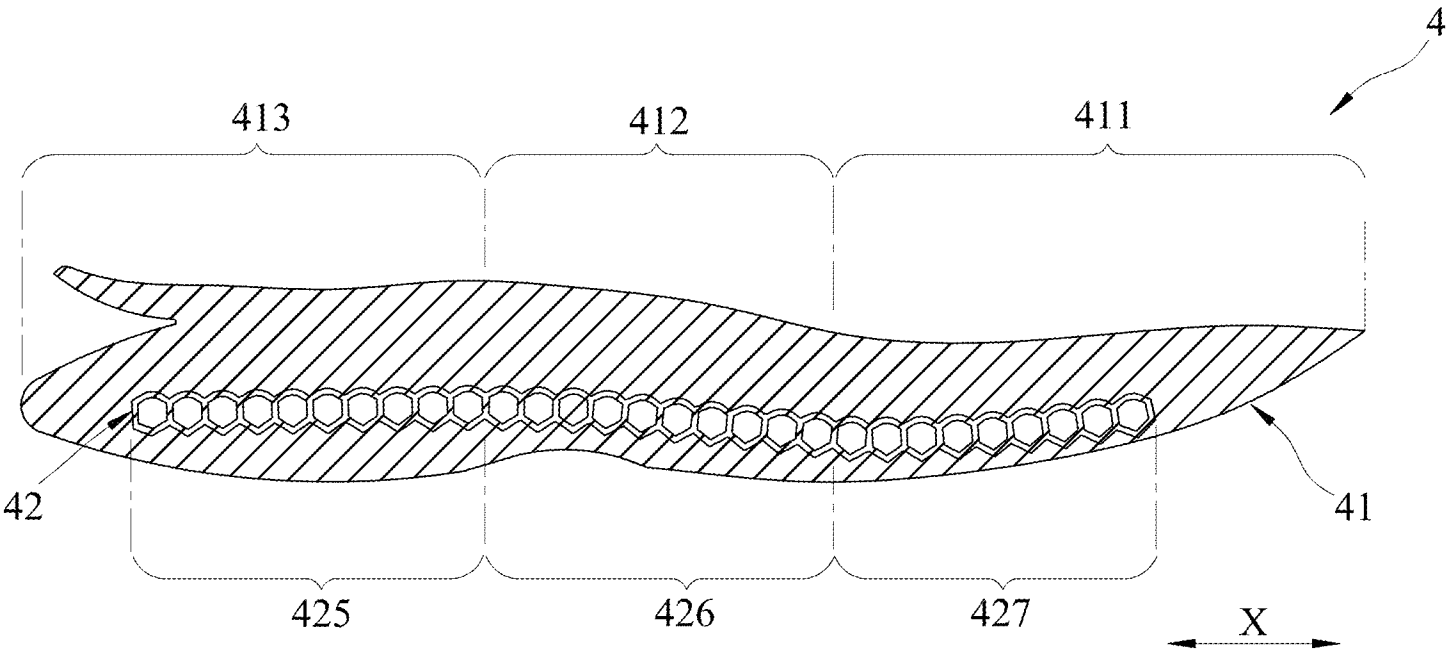
FIG. 6 is a schematic cross-sectional side view of a midsole according to a third embodiment of the disclosure.

Referring to FIG. 6, the shoe 1 of a third embodiment of the present disclosure (the upper 2 and the outsole 3 are omitted in FIG. 6), is similar to that of the first embodiment, except that in the third embodiment, the resilient plate 42 is disposed at the heel region 413, the midfoot region 412 and the forefoot region 411 in a manner that the resilient plate 42 extends along the longitudinal direction (X). A third portion of the resilient tubular elements 421 that is located at the forefoot region 411 serves as a third plate portion 427 (or known as a front plate portion). The third plate portion 427 is connected to the second plate portion 426. The configuration of the third plate portion 427 at the forefoot region 411 assists the runner to push-off and to move forward.

Figure 7:
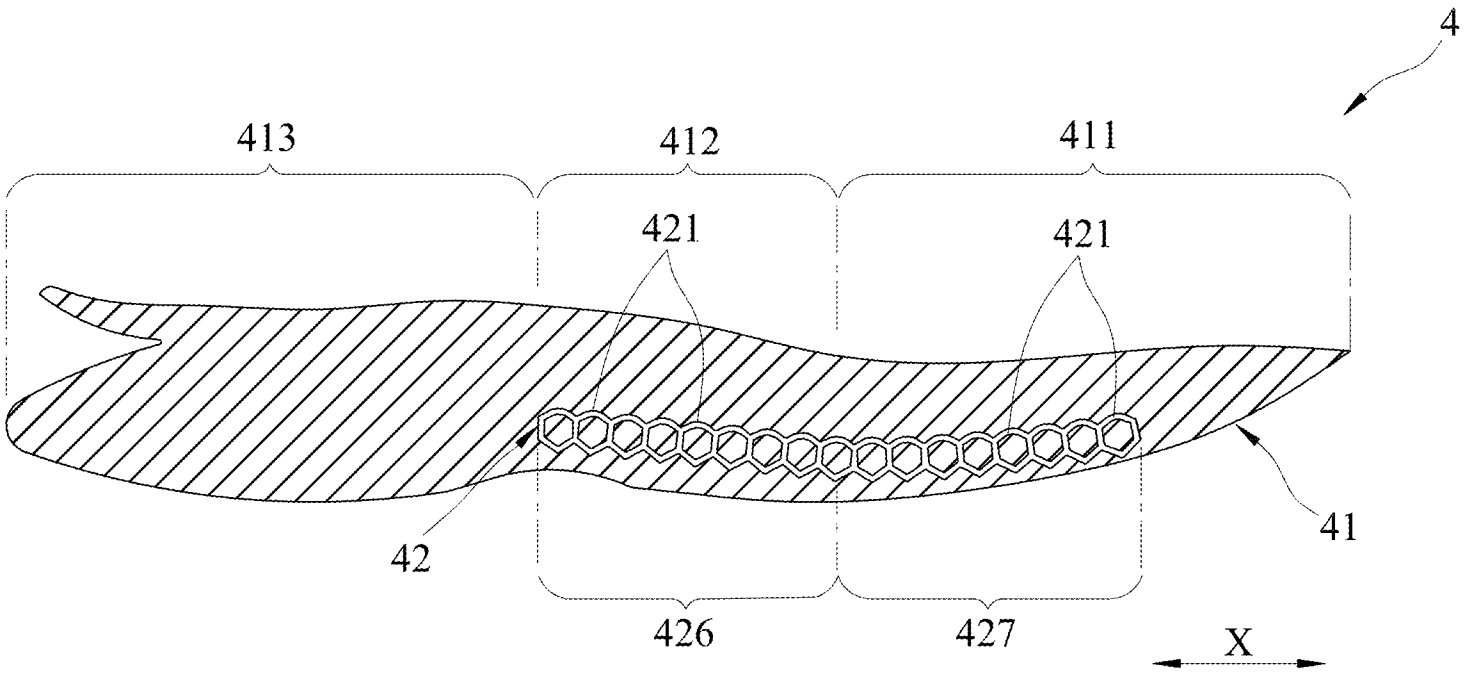
FIG. 7 is a schematic cross-sectional side view of a midsole according to a fourth embodiment of the disclosure.

Referring to FIG. 7, the shoe 1 of a fourth embodiment of the present disclosure (the upper 2 and the outsole 3 are omitted in FIG. 6) is similar to that of the third embodiment, except that in the fourth embodiment, first plate portion 425 is omitted from the resilient plate 42, that is, the resilient plate 42 includes merely the second plate portion 426 and the third plate portion 427.

Figure 8:
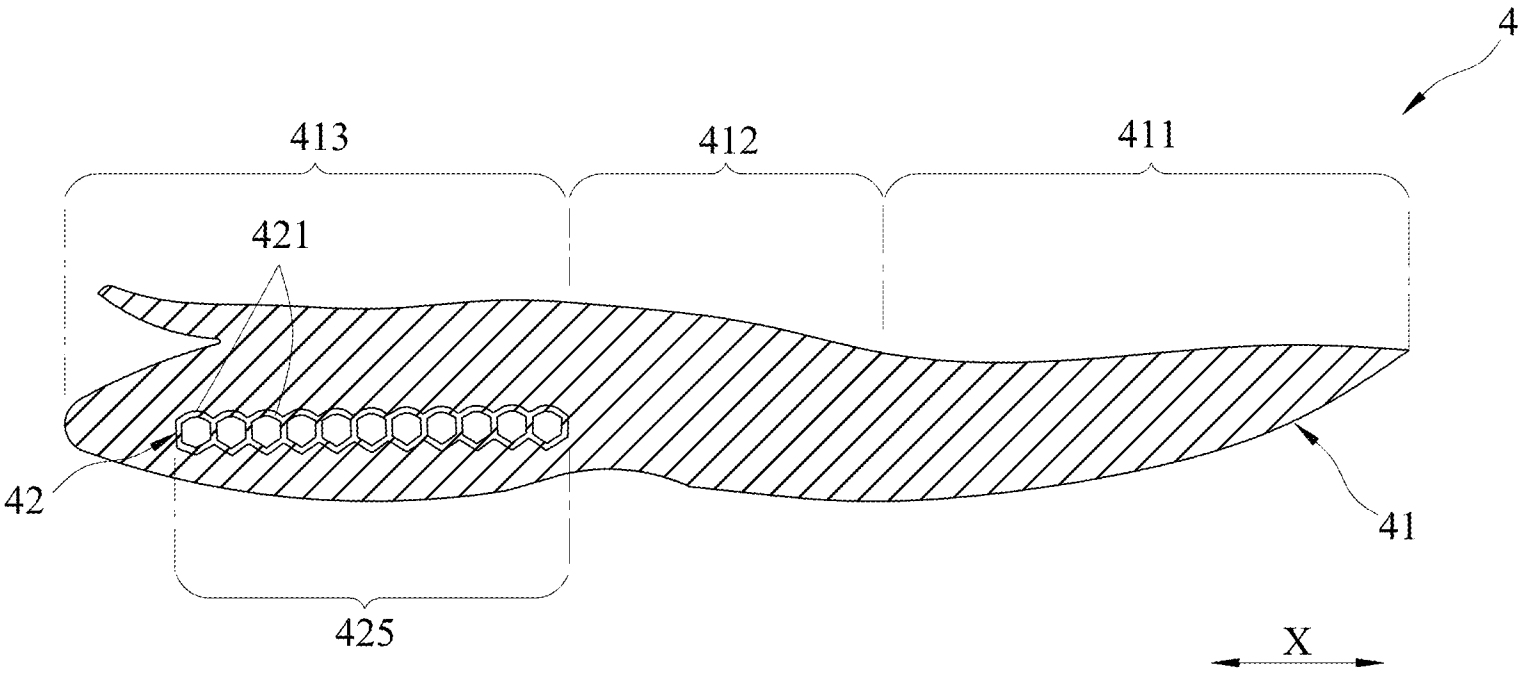
FIG. 8 is a schematic cross-sectional side view of a midsole according to a fifth embodiment of the disclosure.
Figure 9:
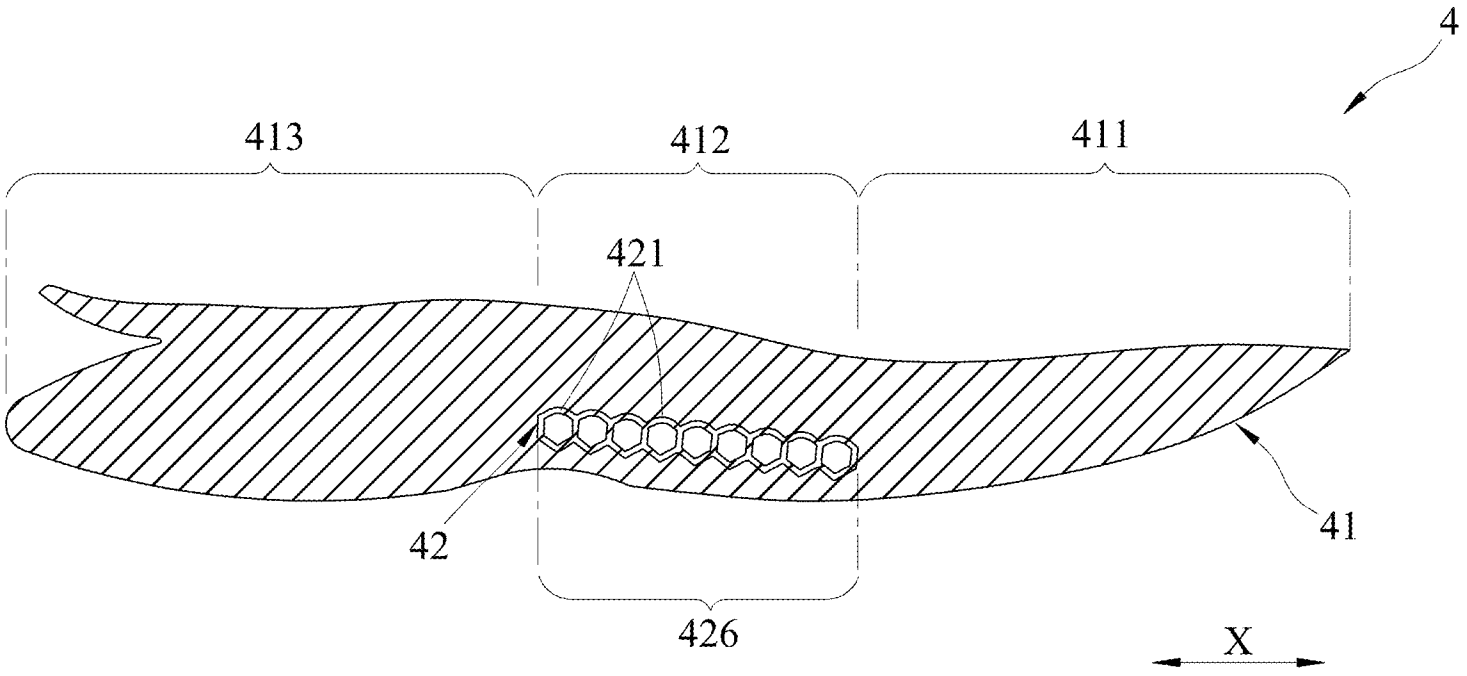
FIG. 9 is a schematic cross-sectional side view of a midsole according to a sixth embodiment of the disclosure.
Figure 10:
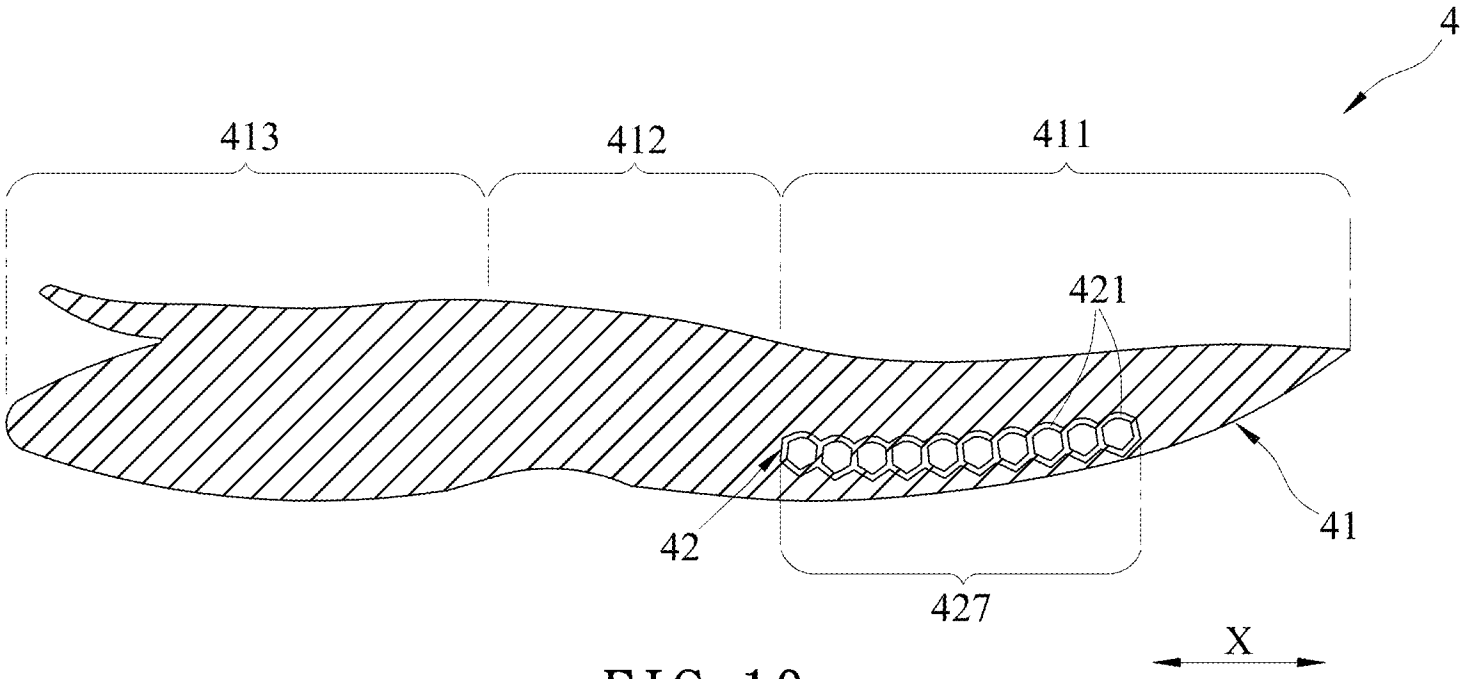
FIG. 10 is a schematic cross-sectional side view of a midsole according to a seventh embodiment of the disclosure.

FIGS. 8 to 10 illustrate the midsole 4 of the shoe 1 of the fifth embodiment, the sixth embodiment, and the seventh embodiment of the present disclosure, respectively. The resilient plate 42 of each of the fifth embodiment, the sixth embodiment, and the seventh embodiment includes merely one of the first plate portion 425, the second plate portion 426, and the third plate portion 427.

Figure 11:
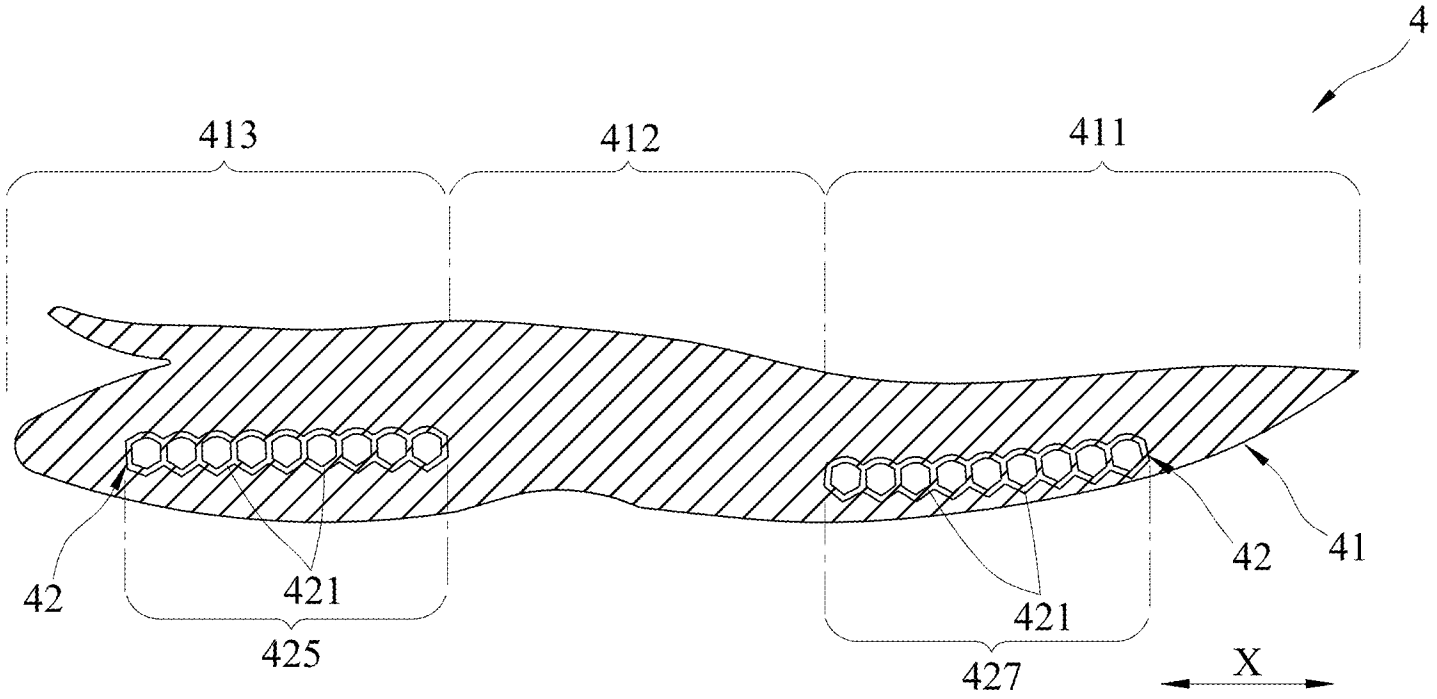
FIG. 11 is a schematic cross-sectional side view of a midsole according to an eighth embodiment of the disclosure.

Referring to FIG. 11, in the shoe 1 of the eighth embodiment of the present disclosure (the upper 2 and the outsole 3 are omitted in FIG. 11), the midsole 4 includes two of the resilient plates 42. The two of the resilient plates 42 respectively extend along the longitudinal direction (X) and are respectively disposed at the heel region 413 and the forefoot region 411. The one of the two of the resilient plates 42 that is located at the heel region 413 serves as a rear plate portion 425 (or is known as the first plate portion). The another one of the two of the resilient plates 42 that is located at the forefoot region 411 serves as a front plate portion 427 (or is known as the third plate portion).

By virtue of the third, fourth, fifth, sixth, seventh, eighth embodiments, it is noted that position and amount of the resilient plate 42 may be adjusted based on practical needs, and such adjustments are within the spirit of the present disclosure.

In sum, in the shoe 1 of the present disclosure, the resilient plate(s) 42 includes a plurality of the resilient tubular elements 421 integrally connected to each other along the longitudinal direction (X), and each of the resilient tubular elements 421 has a cross section in a hexagonal shape. Such configuration permits the resilient plate 42 to have a relatively high strength and high resiliency. By including the resilient plate 42 described above in the midsole body 41 of the midsole 4, the midsole 4 is provides buffering properties and is highly resilient. In addition, by having the second plate portion 426 deflecting downwardly along a direction from the connected end (which is connected to the first plate portion 425) toward the distal end (which is opposite to the first plate portion 425), when the center of gravity shifts to the arch of the foot of the runner, the second plate portion 426 experiences a downward pushing force and thus generates an upward resilience to drive the runner to move forward, so as to speed up the process of shifting the center of gravity from his heel to his forefoot, thereby saving efforts and enhancing smoothness of running.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is(are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A midsole, comprising:

a midsole body; and a resilient plate disposed in said midsole body in a manner that said resilient plate extends along a longitudinal direction, said resilient plate including a plurality of resilient tubular elements that are integrally connected to each other along the longitudinal direction, each of said resilient tubular elements extending along a width direction perpendicular to said longitudinal direction, wherein:

each of said resilient tubular elements is a tube with a cross section in a hexagonal shape, each of said resilient tubular elements having:

two connection walls that are spaced apart from each other along the longitudinal direction;

two lower end walls that respectively extend from bottoms of said two connection walls and that are connected to each other; and two upper end walls that respectively extend from tops of said two connection walls and that are connected to each other, said midsole body includes a forefoot region, a midfoot region integrally connected to said forefoot region, and a heel region integrally connected to said midfoot region;

said resilient plate is disposed at said heel region and said midfoot region in a manner that said resilient plate extends along the longitudinal direction; and a first portion of said resilient tubular elements that is located at said heel region serves as a first plate portion, and a second portion of said resilient tubular elements that is located at said midfoot region serves as a second plate portion, said second plate portion having a connected end that is connected to said first plate portion, and a distal end that is distal from said first plate portion and opposite to said connected end, said second plate portion deflecting downwardly along a direction from said connected end toward said distal end, and said second plate portion forms a deflection angle with respect to said first plate portion, said deflection angle ranging greater than 0° and up to 25°.

2. The midsole as claimed in claim 1, wherein a connection of said two upper end walls of each of said resilient tubular elements is a chamfer having a curved surface.

3. The midsole as claimed in claim 1, wherein said second plate portion is exposed outwardly from a bottom of said midfoot region.

4. The midsole as claimed in claim 1, wherein said resilient plate is further disposed at said forefoot region, a third portion of said resilient tubular elements that is located at said forefoot region serving as a third plate portion, said third plate portion being connected to said second plate portion.

5. A shoe comprising:

an upper;

an outsole; and a midsole as claimed in claim 1, said midsole being connected between said upper and said outsole.

* * * * *